US005456321A

United States Patent [19]

Shiach et al.

[11] Patent Number: 5,456,321

[45] Date of Patent: Oct. 10, 1995

[54] TUBING HANGER INCORPORATING A SEAL

[76] Inventors: Gordon Shiach, 1C Elliothill Street, Dunfermline, Fife, KY11 4TE; Brian MacIntyre, 23 Carnock St Gardens, Milngarvie, Strathclyde, G62 7RU; Greg Glidden, Palos Verdes, Carnock St, Fife, KY12 9JG, all of Great Britain

[21] Appl. No.: 338,997

[22] Filed: Nov. 14, 1994

[30] Foreign Application Priority Data

Mar. 16, 1994 [GB] United Kingdom ..... 9405075

[51] Int. Cl.[6] ..... E21B 33/00

[52] U.S. Cl. ..... 166/382; 166/387

[58] Field of Search ..... 166/381–382, 166/387, 348, 206, 208

[56] References Cited

U.S. PATENT DOCUMENTS 5,193,616 3/1993 Hynes ..... 166/382 X 5,372,201 12/1994 Milberger ..... 166/382

*Primary Examiner*—Michael Powell Buiz

*Attorney, Agent, or Firm*—Lawrence Cruz

[57] ABSTRACT

A tubing hanger for locking to a tubing head is provided on its outer surface with a metal seal that seals between the tubing hanger and the tubing head when weight or hydraulic pressure is applied on the tubing hanger. This can be done either as a result of the weight of tubing hanging from the hanger or by applying pressure on the hanger from above. Elastomer seals may be provided above and below the metal seal so that the integrity of the metal seal can be tested. The seal is broken by disengaging a wedge ring and pulling the tubing hanger out with a running tool. The metal seal can either be used with conventional tubing hangers or with a purpose-designed tubing hanger. In this latter case, the number of operations needed to set the wedge ring can be reduced.

13 Claims, 5 Drawing Sheets

TUBING HANGER INCORPORATING A SEAL

BACKGROUND OF THE INVENTION

The present invention relates to tubing hangers.

A tubing hanger is used in a well, for example an oil well, to suspend a length of tubing within a casing. The tubing hanger, with the tubing suspended beneath it, is lowered into a tubing head at an upper end of the casing and locked to the tubing head.

It is necessary to provide a seal between the exterior surface of the tubing hanger and the tubing head so that the annular space between the casing and the tubing is isolated. This allows the passage of fluids into and from this space.

It has previously been proposed to provide on the tubing hanger a seal which locates between the tubing hanger and the tubing head when the tubing hanger is locked to the tubing head. However, since the tubing hanger with the seal must be moved relatively to the tubing head into a position to be locked to the tubing head, the seal cannot engage the tubing head tightly.

According to a first aspect of the invention, there is provided a tubing hanger for an oil well comprising an exterior surface carrying an annular seal having a portion for engagement with a tubing head when the tubing hanger is located in a tubing head to prevent relative movement between the seal and the tubing head, the tubing hanger being movable axially relative to the seal when so engaged to bring the seal into sealing engagement with the tubing hanger and the tubing head to form an annular seal therebetween.

According to a second aspect of the invention, there is provided a method of sealing a tubing hanger in a tubing head comprising lowering a tubing hanger downwardly into a tubing head until an annular seal extending around the tubing hanger engages a shoulder on an interior surface of the tool head to prevent further relative movement between the seal and the tubing head, continuing said downward movement of said tubing hanger so that said tubing hanger moves relative to said seal, said relative movement forcing the seal into sealing engagement with the tubing head and the tubing hanger.

BRIEF DESCRIPTION OF THE DRAWINGS

The following is a more detailed description of an embodiment of the invention, by way of example, reference being made to the accompanying drawings, in which.

DESCRIPTION OF THE PREFERRED EMBODIMENT

Figure 1:
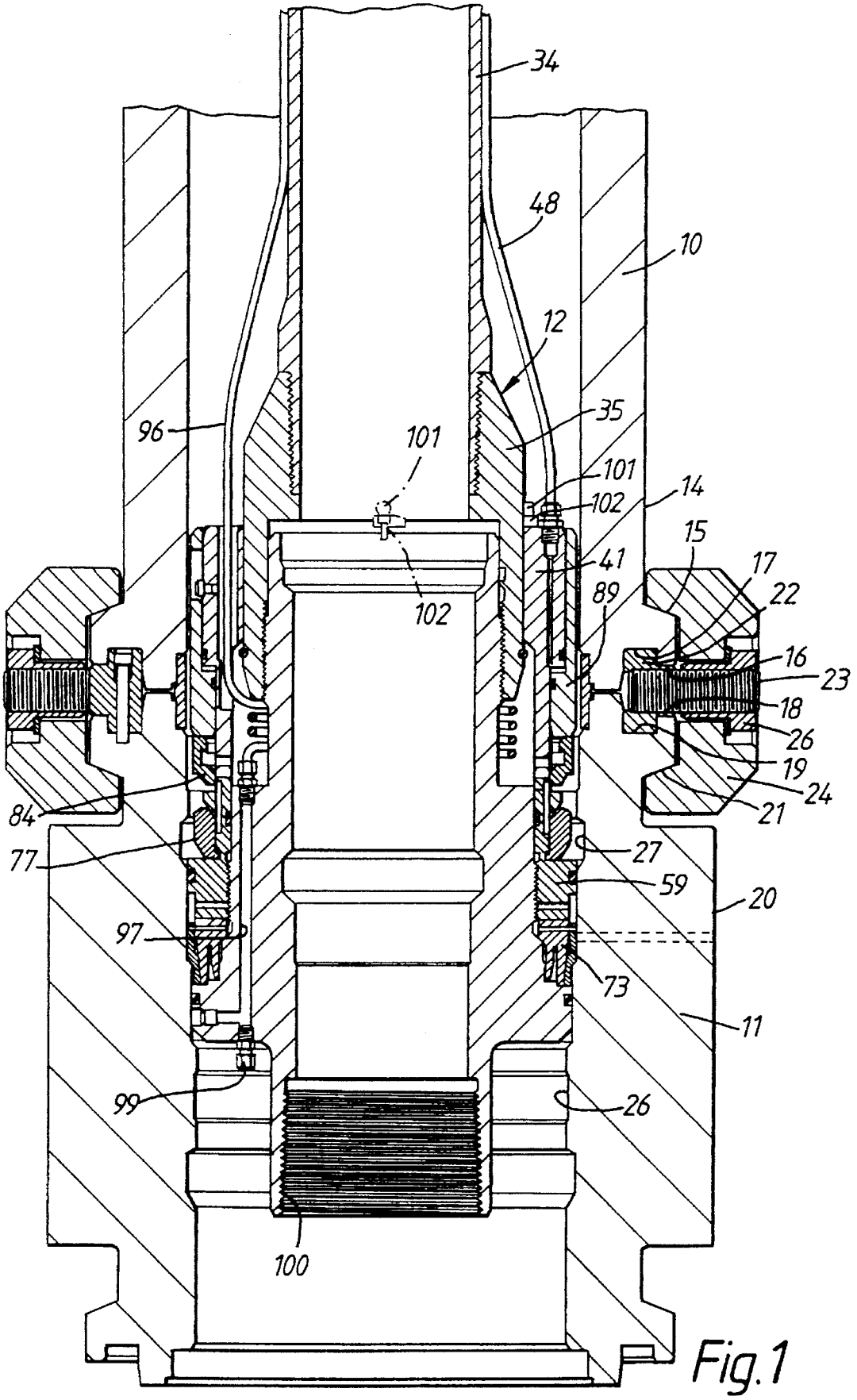
FIG. 1 is a cross-section of a tubing head connected to an end of a riser and containing a tubing hanger connected to a running tool, with the tubing hanger positioned for connection to the tubing head.

Referring to FIG. 1, a riser 10 is connected to a tubing head 11. A running tool 12 carries a tubing hanger 13. The purpose of the arrangement now to be described is to lock the tubing hanger 13 to the tubing head 11 and to form a gas-tight seal between these parts.

The riser 10 has an outer surface 14 provided at its lower end with an annular sloping shoulder 15. An end face 16 of the riser 10 adjacent the shoulder 15 is formed with a channel 17. The tubing head 11 has an upper end face 18 engaging the riser and face 16 and provided with a channel 19 facing the riser channel 17. An outer surface 20 of the tubing head 11 is provided with a sloping annular shoulder 21 complementary to the shoulder 15 on the riser 10.

The riser 10 and the tubing head 11 are connected by a clamping arrangement comprising an annulus of segments 22 whose upper ends engage in the riser channel 17 and whose lower ends engage in the tubing head channel 19. A series of angularly spaced radially outwardly extending bolts 23 project between the riser end face 16 and the tubing head end face 18 and pass through respective clamps 24 which have spaced annular shoulders 25 that engage the riser shoulder 15 and the tubing head should 21 respectively. By tightening nuts 26 on the bolts 23, the clamps 24 are drawn towards the segments 22 to clamp the riser 10 to the tubing head 11.

Figure 2:
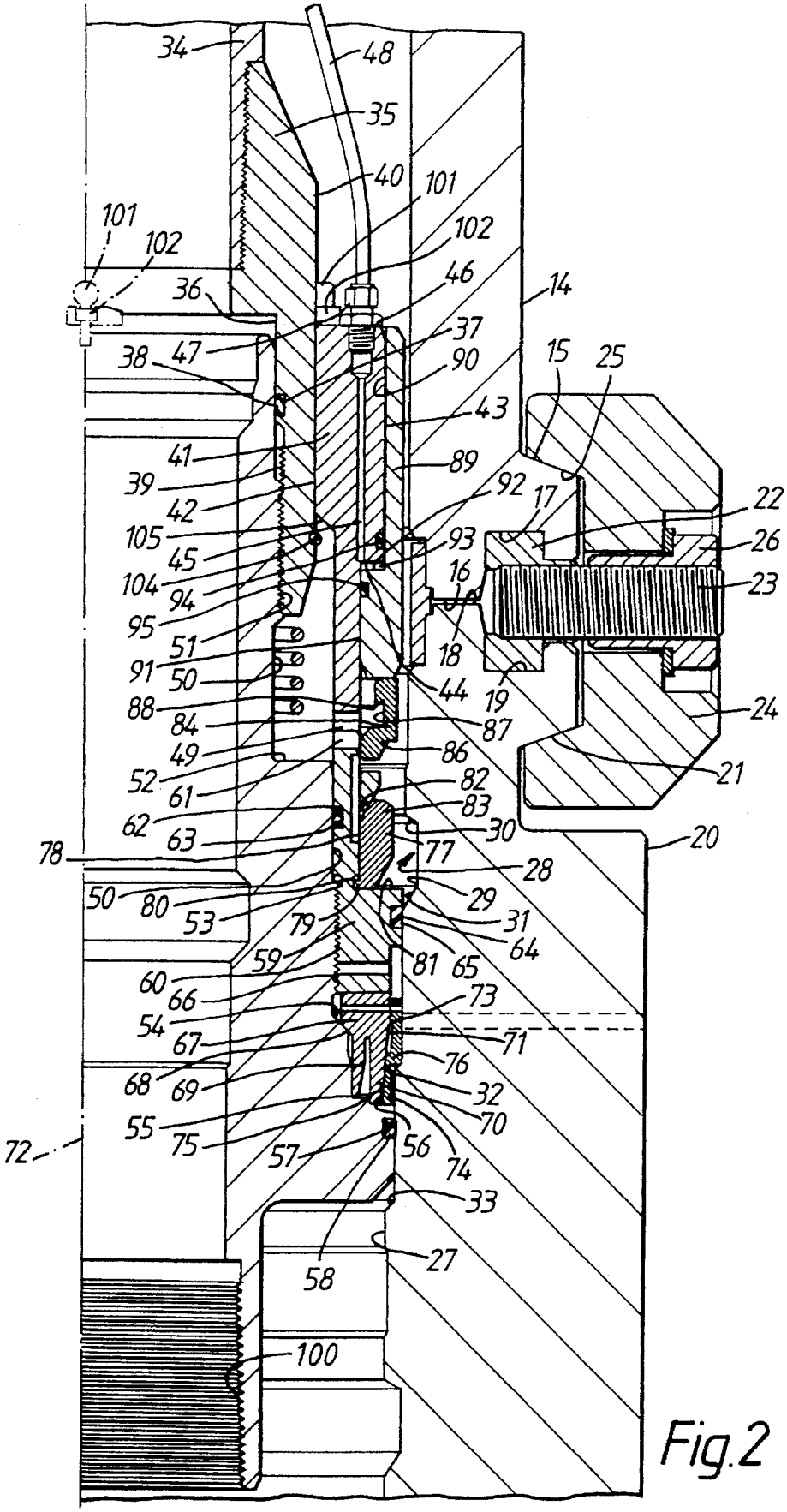
FIG. 2 is a view to a larger scale of a part of the arrangement of FIG. 1 showing in more detail an annular seal and lock ring carried by the tubing hanger.
Figure 3:
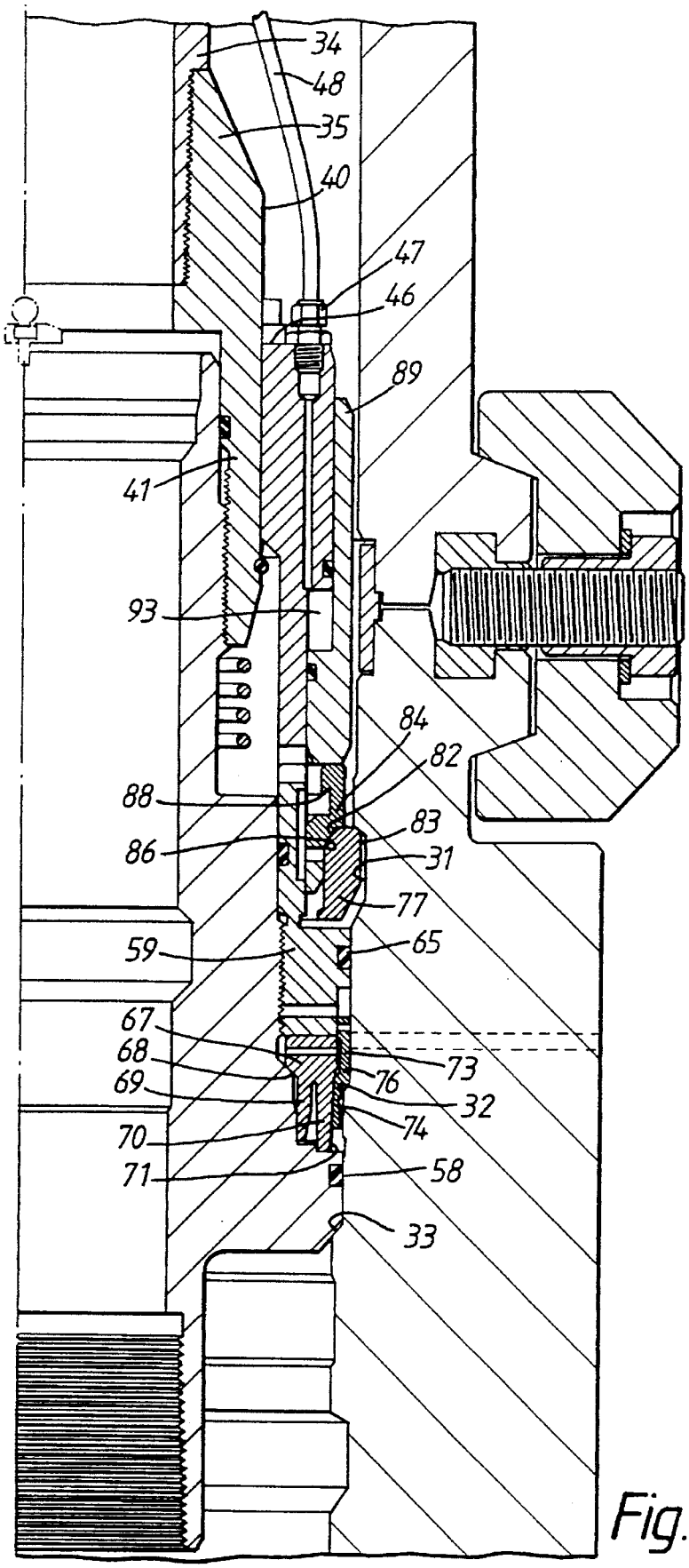
FIG. 3 is a similar view to FIG. 2 but showing the annular seal and the lock ring in operative position.
Figure 4:
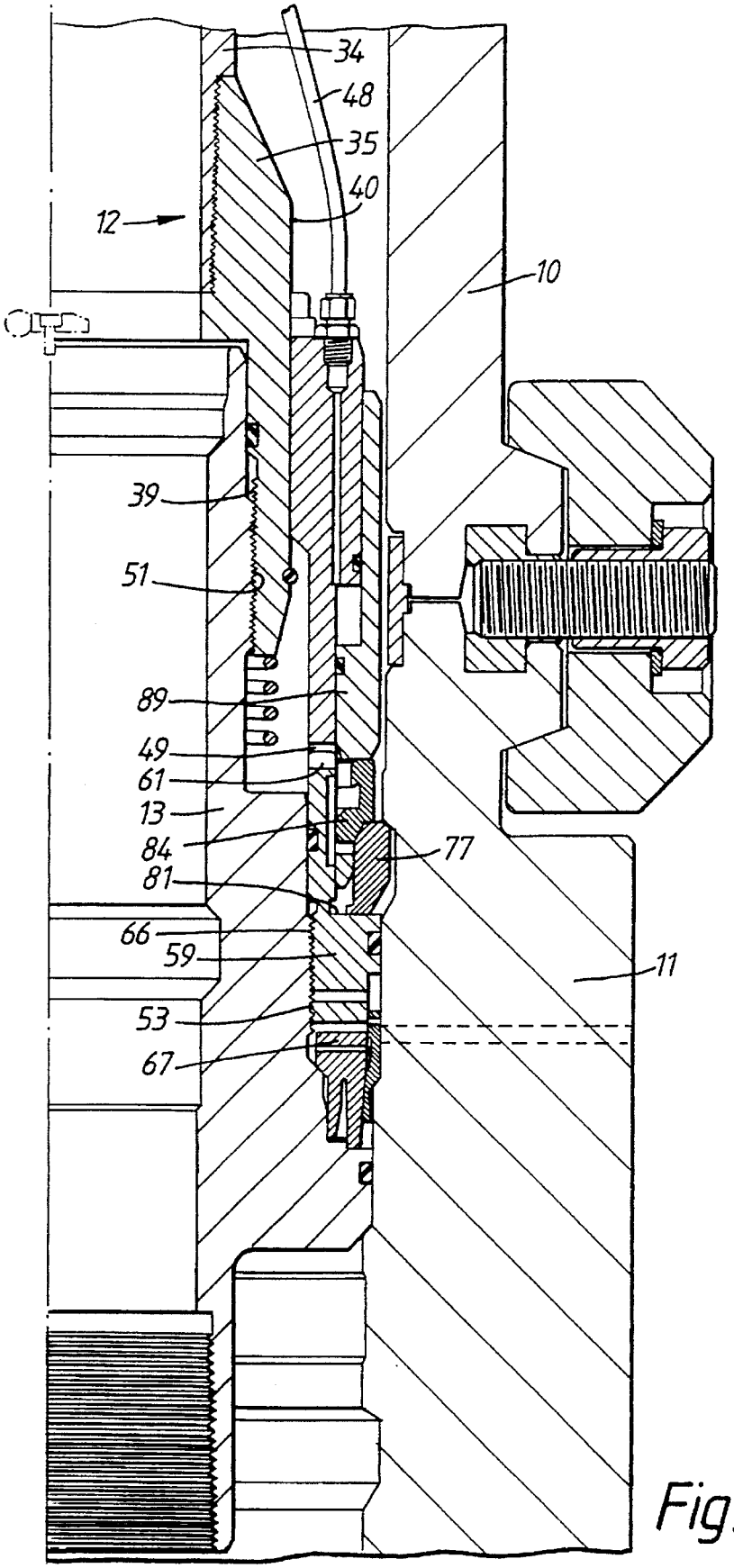
FIG. 4 is a similar view to FIGS. 2 and 3 but showing the lock ring in a clamped position.

The tubing head 11 has an interior surface 27 which, as best seen in FIGS. 2, 3 and 4, has, starting from the top of the tubing head 11, firstly an annular locking groove 28 with a base 29 and upper and lower outwardly splayed end surfaces 30, 31. Next, the interior surface 27 is formed with a first annular inwardly directed load-bearing shoulder 32 followed by a second annular inwardly directed load-bearing shoulder 33. The function of the groove 28 and the steps 32, 33 will be described below.

The tubing head 11 is also provided at its lower end with an arrangement which is a mirror-image of the end face 18, channel 19 and shoulder 21 provided at its upper end. These parts allow the tubing head to be connected to a wellhead in known fashion.

The riser 10 and the tubing head 11 described above with reference to the drawings are of conventional design.

The running tool 12 comprises a tube 34 carrying at its lower end an annular sleeve 35 in screw-threaded engagement with the end of the tube 34. The sleeve 35 has an inner surface 36 provided with a channel 37 carrying an elastomeric seal 38 and provided, beneath the seal 38, with a right-hand thread 39.

The exterior surface 40 of the sleeve 35 carries an annular coupling tube 41 with an interior surface 42 of the coupling tube 41 a sliding fit on the exterior surface 40 of the sleeve 35. The exterior surface 43 of the coupling tube 41 is provided with a downwardly facing radially inwardly directed step 44 intermediate its ends. A bore 45 extends between the step 44 and an upper end face 46 where it connects, via a connector 47, with a feed tube 48 connected in turn to a source of fluid under pressure (not shown).

The coupling tube 41 is castellated at its lower end with a series of spaced teeth 49.

The tubing hanger 13 has a main body with an outer surface 50 provided at an upper end with a thread 51 in engagement with the thread 39 on the sleeve 35. This surface 50, beyond the thread 51, engages with the seal 38 on the sleeve 35. Beneath the thread 51, the tubing hanger 13 is provided with a radially outwardly directed step 52 leading to a portion of the outer surface 50 of increased diameter. This portion is formed successively with a thread 53, a sloping generally radially outwardly extending annular shoulder 54, and radially extending closely axially spaced steps 55, 56. A channel 57 beneath the second step 56 contains an elastomeric seal 58.

The increased diameter portion of the main body of the tubing hanger 13 carries an annular locking member 59 having an inner surface provided with a thread 60 engaging with the thread 53 on the surface 50. These threads 53, 60 are left-hand threads.

The upper end of the locking member 59 is provided with castellations whose teeth 61 interleave with the teeth 49 of the castellations on the coupling tube 41 with axial spacing between the ends of the teeth on one part and the ends of the spaces on the other part. A channel 62 adjacent the teeth 61 and on the interior surface of the sealing member 59 carries an elastomeric seal 63 that engages with the exterior surface 50 of the main body of the tool hanger 13. The exterior surface of the sealing member 59 includes a channel 64 carrying an elastomeric seal 65.

The thread 51 also engages a thread 66 on an annular sealing member 67 whose upper end, in the position shown in FIGS. 2 and 3, abuts the lower end of the locking member 59. The sealing member 67 is provided on its inner surface with a sloping annular face 68 that engages with the shoulder 54 on the main body of the tubing hanger 13. The locking member 67 is formed with inner and outer radially spaced annular sealing rings 69, 70 projecting from the lower end of the sealing member 67.

The inner sealing ring 69 has a lower end that abuts against the first step 55 and the outer sealing ring 70 has a lower end that abuts against the second step 56. The exterior surface 71 of the outer sealing ring 70 is frusto-conical to form a self-locking taper which may be angled at 50 to the common axis 72 of the riser 10, tubing head 11, running tool 12 and tool hanger 13, so that the surface 71 slopes inwardly from top to bottom.

An annular hydraulically energized seal 73 of metal extends around the sealing member 67 and includes an inwardly cranked lower portion 74 whose inner surface 75 bears against a lower portion of the frusto-conical exterior surface 71 of the outer sealing ring 70. The crank forms a step 76 intermediate the axially spaced ends of the seal 73. The lower end of the lower portion 74 is provided with spikes 76 or similar projections on its inner and outer surfaces. The upper end of the hydraulically energized seal 73 is in sliding engagement with the exterior surface of the sealing ring 69.

A lock ring 77 is located between the sealing member 67 and the coupling tube 41 and comprises an annular inner surface 78 formed at its lower end with an inwardly projecting bead 79 which, in the position of the lock ring 77 shown in FIG. 2, engages in an annular groove 80 extending around an inner end of a radial step 81 in the locking member 59. An upper end of the inner surface 78 of the lock ring 77 is provided with an outwardly directed chamber 82. The outer surface 83 of the lock ring 77 is of complementary shape to the shape of the locking groove 28 in the tubing head 11.

An energizing ring 84 is located above the lock ring 77 and has a lower end with a tapered outer surface so that the narrower lower end of the energizing ring 84 fits between the chamber 82 on the lock ring 77 and the adjacent outer surface of the locking member 59. The energizing ring 84, intermediate its ends, is provided with an annular outwardly facing angled shoulder 86 complementary to the chamber 82 on the lock ring 77. An upper end of the energizing ring 84 has an inner surface 87 provided with a downwardly facing undercut 88 for a purpose to be described below.

An annular piston 89 has an upper portion 90 of its outer surface in sliding engagement with the exterior surface 43 of the coupling tube 41 above the step 44 and a lower surface portion 91 in engagement with the exterior surface 43 of the coupling tube 41 beneath the step 44. A step 92 extends between the upper and lower surface portions 90, 91 to define a chamber between the step 92 and the adjacent step 44 on the coupling tube 41. A seal 94 between the lower surface portion 91 and the coupling tube 41 and a seal 95 between the coupling tube 41 and the upper surface portion 90 of the piston make the chamber 93 fluid-tight.

A lower end of the piston 89 bears on an upper end of the actuator ring 85.

As best seen in FIG. 1, a control line 96 extends along the exterior surface of the riser 10 and passes through a bore 97 in the coupling tube 41 to emerge in the space between the tubing hanger 13 and the inner surface of the coupling tube 41 where it completes four turns around the tubing hanger 13 before connecting to a passage 98 extending through the main body of the tubing hanger 13 and emerging at a connector 99 at the lower end of the tubing hanger 13. This line 96 is for the supply of fluid to the annular space between the tubing head 11 and the tool hanger 13.

The lower end of the main body of tubing hanger 13 is provided with an interior thread 100 for connecting the tubing hanger 13 to an associated length of tubing which may be thousands of meters in length, as is well known.

In use, the riser 10 is clamped to the tubing head 11 as described above using the segments 22 and the clamps 24. In addition, the tubing head 11 will itself be clamped to a well head (not shown) by a similar clamping arrangement.

Prior to use offshore, the sealing member 67 and the locking member 59 are threaded onto the tool hanger 13. The hydraulically energized seal 73 is pre-positioned on the sealing member 67. The lock ring 77 and the energizing ring 84 are fitted over the locking member 59 and the sleeve 35 is threaded on the tool hanger 13 carrying the coupling tube 41 and the piston 89 with the castellations on the coupling tube 41 being engaged with the castellations on the locking member 59. The tube 34 is threaded on the sleeve.

While at the rig floor, at the upper end of the riser 10, the tubing hanger 13 is engaged with the end of a tubing string (not shown) via the thread 100.

The running tool 12 and the tool hanger 13 are then lowered through the riser 10 using the tubing 34. This continues until the step 76 on the hydraulically energized seal 73 engages the first should 32 on the interior of the tubing head 11. This position is shown in FIG. 2.

As seen in that Figure, in this disposition, the end of the tool hanger 13 is spaced axially from the second shoulder 33 on the tubing head 11, and the lock ring 77 and energizing ring 84 are axially spaced from one another with the chamber 93 of minimum size.

Next, the tubing hanger 13 is pressed down. This can be done in one of two ways. First, it can be pressed down simply by the weight of the tubing hanging beneath the tubing hanger 13 which, as mentioned above, may be thousands of meters long. Alternatively, where a blowout preventor is applied at the head of the riser 10, the blowout preventor is closed around a spanner joint and the volume below the spanner joint and above the tubing hanger 13 is pressurized to cause downward movement of the hanger 13.

In either case, the effect is to move the hanger 13 downwardly until the end of the hanger 13 engages the second shoulder 33 on the interior of the tubing head 11. The hydraulically energized seal 73 cannot move with the hanger 13 by virtue of the engagement between the step 76 on the hydraulically energized seal 73 and the first step 33 on the tubing head 11. This causes the lower portion 74 of the hydraulically energized seal 73 to slide up the frusto-conical self-locking taper on the exterior surface 71 of the outer sealing ring 70 so forcing the spikes or projections on the hydraulically energized seal 73 to coin into tight sealing engagement with both the outer sealing ring 74 and the inner surface 27 of the tubing head 11 to form a fluid-tight seal between these parts and so between the tubing hanger 13 and the tubing head 11.

Next, the lock ring 77 is set by supplying fluid under pressure through the feed tube 44 and the bore 45 to the chamber 93. This causes the piston 89 to move downwardly relative to the coupling tube 41 so pushing the energizing ring 84 behind the lock ring 77, with the taper on the energizing ring 84 engaging the chamber 82 on the wedge ring 77. This causes the lock ring 77 to expand outwardly into the locking groove 28 on the tubing head 11.

This is the position shown in FIG. 3. It will be seen that, in this position, there is a gap between the end of the lock ring 77 and the locking member 59 which could allow movement between the tubing hanger 13 and the tubing head 11. This is taken up in the following way.

The tube 34 is rotated in a clockwise direction. This causes relative rotation between the sleeve 35 and the tubing hanger 13 via the threads 39, 51. It also causes relative rotation between the sleeve 35 and the coupling tube 41 with a pin 101 projecting radially from the exterior of the coupling tube 41 disengaging from the top of a block 102 on the coupling tube 41 and rotating relative to the block 102. After the completion of one revolution, the pin 101 engages a side of the block and thus picks up the coupling tube 41, so rotating the coupling tube 41. This rotation is transmitted via the castellations to the locking member 59 which, because the threads between the locking member 59 and the tubing hanger 13 are of the opposite hand to the threads between the sleeve 35 and the tubing hanger 13, cause the locking member 59 to move axially upwardly on rotation with the relative motion between the coupling tube 41 and the locking member 59 being taken up by the axial play in the castellations.

This brings the radial step 81 on the sealing locking member 59 into engagement with the lower end of the lock ring 77 so clamping the lock ring 77 between the step 81 and the piston 89 so preventing relative axial movement between the tubing hanger 13 and the tubing head 11. This position is shown in FIG. 4.

The running tool 12 is then retrieved by reverse rotation of the tube 34 to rotate the sleeve 35 off the thread 51 on the tubing hanger 13. The sleeve 35 rotates relative to the coupling tube 41 but picks up the coupling tube by engagement of a lock ring 104 on the exterior surface of the sleeve 35 with a step 105 on the interior of the coupling tube 41. The chamber 93 is depressurized so that the piston 89 pulls out with the remainder of the running tool.

The integrity of the seal formed by the hydraulically energized seal 73 can be tested by supplying fluid under pressure through the tubing head 11 to the annular space between the tubing hanger 13 and the tubing head 11 bounded at one end by the seal 58 on the tubing hanger 13 and at the other end by the seal 63 on the locking member 59. If the seal is found to be faulty, the running tool 12 can be lowered down the riser 10 and fitted, in known fashion, with flexible fingers that splay inwardly behind the energizing ring 84 and engage the undercut 88. This pulls the actuator ring 85 and the energizing ring 84 from behind the lock ring 77 and allows the lock ring 77 to contract under its own resilience.

The tubing hanger 13 can then be pulled upwardly with the slope on the exterior surface 71 of the sealing ring 69 allowing the hydraulically energized seal 73 to disengage from the outer sealing ring 70 and the tubing head 11.

The hydraulically energized seal 73 can then be re-set as described above.

The arrangement described above with reference to FIGS. 1 to 3 uses a tubing hanger which, apart from the hydraulically energized seal 73 and the inclined exterior surface 71 of the outer sealing 70 is generally the same as known tubing hangers. In an alternative embodiment, now to be described with reference to FIG. 5, a new form of tubing hanger 13 is used.

Figure 5:
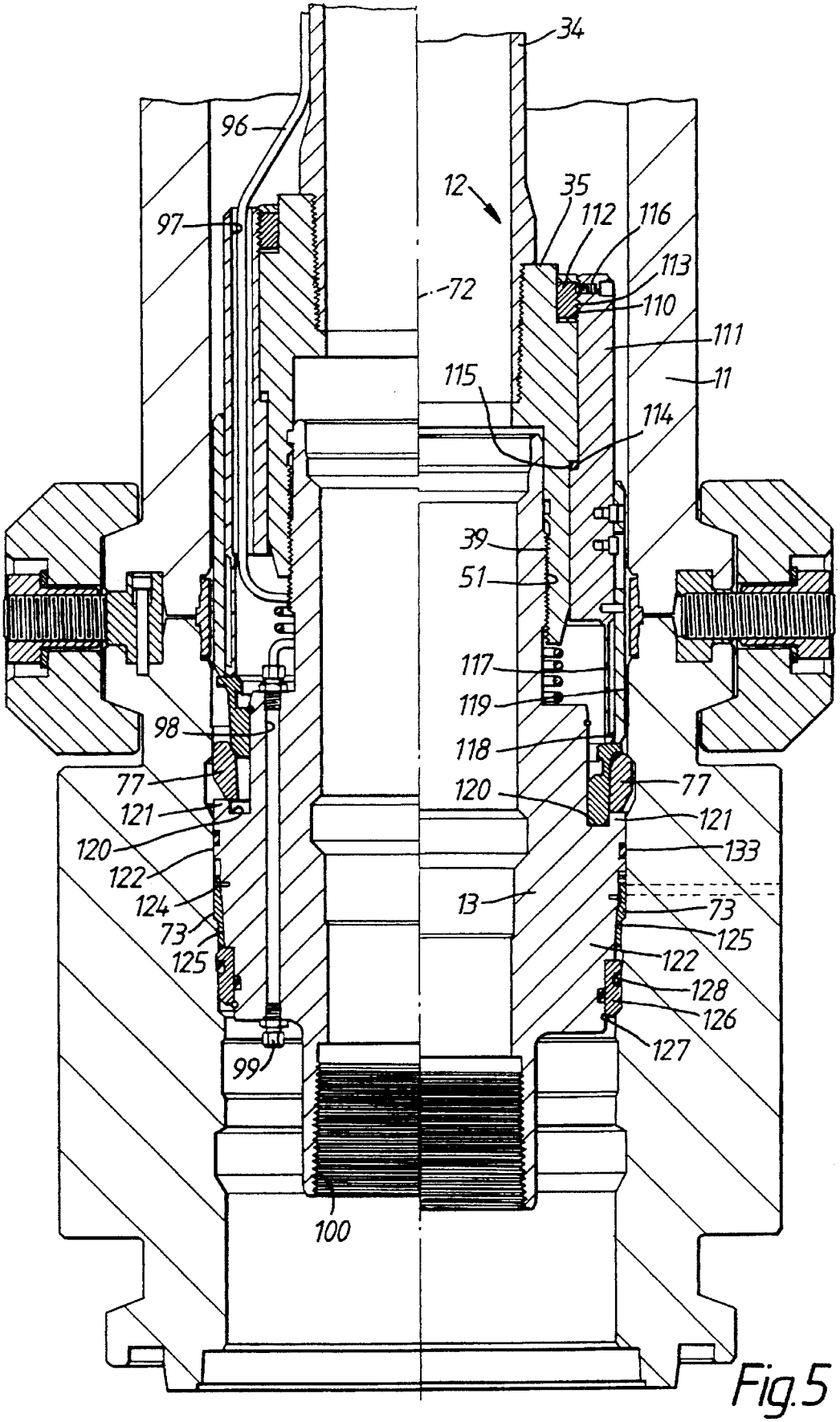
FIG. 5 is a similar view to FIG. 1 but showing an alternative form of tubing hanger, the left-hand side of the Figure showing the tubing hanger in an initial position for connection to the tubing head and the right-hand side of the Figure showing the tubing hanger connected and sealed to the tubing head.

In the embodiment of FIG. 5, there are a number of parts which are common to that Figure and to FIGS. 1 to 4. Those parts will be given the same reference numerals and will not be described in detail.

In the embodiment of FIG. 5, the riser 10 and the tubing head 11 are described above with reference to FIGS. 1 to 4. The sleeve 35 has, at its upper end, an outwardly directed annular step 110. The coupling tube 41 and the piston 89 are omitted and are replaced by an annular actuating member 111 which is a sliding fit over the exterior of the sleeve 35 and is connected to the sleeve by a lock ring 112 engaging a thread 113 on the inner surface of the upper end of the actuating member 111 so that the lock ring 112 engages the step 110 to draw a rebate 114 on the inner surface of the actuating member 111 into engagement with an oppositely directed rebate 115 on the exterior surface of the sleeve 35.

The lock ring 112 is prevented from rotation by a grub screen 116 extending through the upper end of the actuating member 111.

The actuating member 111 is formed at its lower end with a plurality of circumferentially-spaced axially-extending fingers 117 provided at their ends remote from the member 111 with respective hooks 118. The hooked end of each finger 117 engages an upper surface of the energizing ring 84.

The actuating member 111 also carries an annular ring drive sleeve 119 whose upper end is bolted onto the exterior surface of the actuating member 111 and whose lower end also engages the upper surface of the energizing ring 84.

A second set of attachment points are provided on the actuating member 111 at a position spaced axially upwardly from the attachment point shown in FIG. 5 so that the drive sleeve 119 can be attached to the actuating member 111 at a position spaced axially upwardly from the position shown in FIG. 5. The reason why this is required is explained below.

The assembly of the locking member 59 and the sealing member 67 are omitted completely. Instead, the exterior surface of the main body of the tubing hanger 13 is formed with an annular step 120 terminating at its outer end in an annular flange 121 on which rests the lower end of the lock ring 77. The portion 122 of the exterior surface of the main body of the tubing hanger 13 below the flange 121 is formed firstly with an elastomeric seal 133, and then with a recessed section which receives the hydraulically energized seal 73 connected to the tubing hanger 13 by frangible pins 124. The frusto-conical surface 125 of this recessed portion forms a self-locking taper which may be angled at 5° relative to the axis 72 so that, in the position shown to the left-hand side of FIG. 5, the lower portion 74 of the hydraulically energized seal 73 is a loose fit between the tubing head 11 and the main body of the tubing hanger 13.

This surface 122 of the main body of the tubing hanger 13 also carries a load shoulder ring 126 whose upper end engages the lower end of the hydraulically energized seal 73 in the disposition shown to the left of FIG. 5 to prevent the hydraulically energized seal 73 falling off the end of the main body of the tubing hanger 13, and which is held on to the tubing hanger 13 by an O-ring 127 carried by the hanger 13 and engaging the lower end of the ring 126.

A seal 128 is provided between the exterior surface 122 of the main body of the tubing hanger 13 and the inner surface of the ring 126 and the outer surface of the ring 126 carries a second seal 128.

In use, the riser 10 and tubing head 11 are positioned as described above. The running tool 12 is connected to the tubing hanger 13 with the energizing ring 84 axially spaced from the lock ring 77 and engaging with the fingers 117 and the drive sleeve 119.

The tube 34 is used to position the running tool 12 and the tubing hanger 13 in the tubing head 11 so that the step 76 on the hydraulically energized seal 73 engages the first step 32 on the tubing head 11. This is the disposition shown to the left-hand side of FIG. 5.

Weight is then set on the tubing hanger 13 in either of the ways described above with reference to FIGS. 1 to 4. This causes the tubing hanger 13 to move downwardly and, since the hydraulically energized seal 73 is prevented from making such movement, the frangible pins 124 shear and the lower portion 74 of the hydraulically energized seal 73 is wedged between the exterior surface 122 of the tubing hanger 13 and the interior surface of the tubing head 11 to form a seal between the parts. This movement continues until the ring 126 engages the second step 33 on the tubing head 11.

The tube 34 is then rotated to rotate the running tool 12 relative to the tubing hanger 13 via the threads 39, 53. This causes downward axial movement of the drive sleeve 119 (and the fingers 117) which urges the energizing ring 84 behind the lock ring 77 so forcing the lock ring 77 out into the locking groove 28 in the tubing head 11. The radially inner surface of the lock ring 77 is frusto-conical to form a self-locking taper which may be a 5° inward taper from top to bottom to give a progressively greater wedging action as the energizing ring 84 is forced behind the lock ring 77. This action continues until the end of the energizing ring 84 enters the channel behind the flange 121 on the step 120 of the tubing hanger 13.

The tube 34 can then be rotated in an opposite sense to withdraw the running tool 12 to the surface. The integrity of the seal can then be tested as described above.

If the seal is not effective, the tubing hanger 13 can be withdrawn in the following way. First, the drive sleeve 119 is uncoupled from the mounting point shown in FIG. 5 and recoupled in the axially upwardly spaced position described above. This leaves the ends of the fingers 117 projecting below the end of the drive sleeve 119.

The running tool 12 can then be lowered down the riser 10 using the tube 34 until the threads 39 on the sleeve 25 are engaged with the threads 53 on the tubing hanger 13. The tube 34 is then rotated in a clockwise direction until the fingers 17 contact the upper end of the energizing ring 84 when the fingers 117 flex inwardly until their hooks 118 engage the undercut 88. The tube 34 can then be rotated counter-clockwise to pull the energizing ring 84 from behind the lock ring 77 so allowing the lock ring to move out of the locking groove 28 by its own resilience. Rotation is then halted and the running tube 12 and tubing hanger 13 can be withdrawn together with the hydraulically energized seal 73 being picked up by the ring 126.

The hydraulically energized annular seal 73 described above with reference to the drawings is intended for use primarily in well head workover situations. The portion of the tubing head 11 receiving the tubing hanger 13 cannot be re-machined; after installation only the originally tubing hanger can be removed and replaced by a new one. In this situation, the seal between the tubing hanger 13 and the tubing head 11 should preferably seal onto a previously used tubing head surface but located away from the same location as the original seal. This is achieved by locating the lower portion 74 of the hydraulically energized seal 73 with bumps or spikes above and below the location of the original sealing circumferential band in the tubing head 11.

While the preferred embodiment of the present invention has been herein shown and described, it is understood that variation can be made without departing from what is regarded as the scope of the invention.

What is claimed is:

1. A tubing hanger for an oil well comprising an exterior surface carrying an annular seal having a portion for engagement with a tubing head to prevent relative movement between the seal and the tubing head, the seal being movable axially relative to the tubing hanger when so engaged to bring a sealing portion of the seal into sealing engagement with the tubing hanger and the tubing head to form an annular seal therebetween.

2. A tubing hanger according to claim 1 wherein the sealing portion of the seal overlies a portion of the tubing hanger provided with a self-locking taper such that, on said movement of the seal relative to the tubing hanger, the sealing portion moves along said taper and radially outwardly of said surface to urge the sealing portion into said sealing engagement.

3. A tubing hanger according to claim 1 or claim 2 wherein the seal is provided with an inwardly directed annular step intermediate axially spaced ends thereof, said step forming said tubing head-engaging portion and engaging a step on the tubing head to prevent said relative movement.

4. A tubing hanger according to claim 3 and comprising a main body having at an upper end a thread for engagement with a running tool and at a lower end a thread for engagement with a tubing string, said exterior surface being formed on said main body.

5. A tubing hanger according to claim 4 wherein said annular seal is prevented from falling off the main body by a ring extending around said main body at a lower end of said exterior surface.

6. A tubing hanger according to claim 3 and comprising a main body having at an upper end a thread for engagement with a running tool and at a lower end a thread for engagement with a tubing string, the main body carrying on an outer surface thereof an annular sealing member, said exterior surface being formed on said annular sealing member.

7. A tubing hanger according to claim 6 and comprising two axially spaced annular elastomeric seals extending therearound on respective opposite sides of the seal for sealing engagement with an associated well head to isolate said seal so that the integrity of the seal can be tested by the supply of fluid under pressure between the elastomeric seals.

8. A tubing hanger according to claim 7 and including a lock ring for radially outward expansion into locking engagement with a locking groove on an associated tubing head, an energizing ring being provided and being movable between a radially inner surface of the lock ring and an adjacent surface of the remainder of the tubing hanger to force the lock ring radially outwardly into said locking engagement, said radially inner lock ring surface being a frusto-conical surface of decreasing diameter in the direction of wedging movement of the energizing ring.

9. A tubing hanger according to claim 8 wherein the sealing portion is provided with projections which, when the sealing portion is in said sealing engagement, coin into the tubing hanger and the tubing head on at least one projection to form the seal.

10. A method of sealing a tubing hanger in a tubing head comprising lowering a tubing hanger downwardly into a tubing head until an annular seal extending around the tubing hanger engages a shoulder on an interior surface of the tubing head to prevent further relative movement between the seal and the tubing head, continuing said downward movement of said tubing hanger so that said tubing hanger moves relative to said seal, said relative movement forcing the seal into sealing engagement with the tubing head and the tubing hanger.

11. A method according to claim 10 wherein, during said relative movement between the tubing hanger and the seal, the seal rides up a frusto-conical surface on the tubing hanger to force said seal into said sealing engagement.

12. A method according to claim 11 wherein said continued downward movement of the tubing hanger is achieved by setting weight on the tubing hanger.

13. A method according to claim 12 wherein said continued downward movement of the tubing hanger is achieved by applying fluid under pressure to an upper surface of the tubing hanger.

* * * * *